US005293197A

United States Patent [19]

Iwao

[11] Patent Number: 5,293,197

[45] Date of Patent: Mar. 8, 1994

[54] IMAGE FORMING DEVICE CAPABLE OF BEING MAINTAINED EASILY BY USING IC CARD

[75] Inventor: Soichi Iwao, Toyohashi, Japan

[73] Assignee: Minolta Camera Kabushiki Kaisha, Osaka, Japan

[21] Appl. No.: 50,998

[22] Filed: Apr. 22, 1993

Related U.S. Application Data

[63] Continuation of Ser. No. 738,147, Jul. 30, 1991, abandoned.

[30] Foreign Application Priority Data

Jul. 31, 1990 [JP] Japan ..... 2-204259

[51] Int. Cl.[5] ..... G03G 21/00

[52] U.S. Cl. ..... 355/204; 355/203; 355/208

[58] Field of Search ..... 355/200, 202, 203, 204, 355/206, 208, 209; 364/401, 424.03, 424.04, 525, 550; 358/296, 300; 395/275, 650

[56] References Cited

U.S. PATENT DOCUMENTS

| | | | |
|---|---|---|---|
| 4,159,531 | 6/1979 | McGrath | 364/424.04 |
| 4,258,421 | 3/1981 | Juhasz et al. | 364/424.04 |
| 4,400,783 | 8/1983 | Locke, Jr. et al. | 364/550 X |
| 4,490,798 | 12/1984 | Franks et al. | 364/424.04 |
| 4,764,789 | 8/1988 | Iwaki et al. . | |
| 4,806,978 | 2/1989 | Nakatani et al. | 355/202 |
| 5,027,153 | 6/1991 | Komiya | 355/200 |
| 5,038,273 | 8/1991 | Ito et al. | 355/204 X |
| 5,041,873 | 8/1991 | Kawabuchi et al. | 355/208 |

FOREIGN PATENT DOCUMENTS

| | | |
|---|---|---|
| 62-75747 | 4/1987 | Japan . |
| 62-254248 | 11/1987 | Japan . |
| 1-138569 | 5/1989 | Japan . |

*Primary Examiner*—A. T. Grimley
*Assistant Examiner*—Sandra L. Brasé
*Attorney, Agent, or Firm*—Burns, Doane, Swecker & Mathis

[57] ABSTRACT

An image forming apparatus according to the present invention is operable in response to information from a storage medium detachably provided at a main body of the apparatus. The apparatus includes a connector to which an IC card storing management data indicative of an improvement history of the apparatus is connected, a reader for reading management data from the connected IC card, a first display for displaying the improvement history of the apparatus based on the read management data, an input device for inputting state data indicative of the stage in the improvement history of the apparatus, a memory storing the input state data and a second display displaying the stage in the improvement history of the apparatus based on the state data in the memory.

24 Claims, 10 Drawing Sheets

FIG. 7

62

TONER CHANGE INFORMATION ( ' 88. 11. 25)

| I. CHANGE ITEM | II. CHANGE STATUS |
|---|---|
| (1) TONER TYPE A<br>TONER<br>CONCENTRATION : 5 | (1) UNCHANGED FROM STATUS AT SHIPPING OF MACHINE |
| (2) TONER TYPE B<br>TONER<br>CONCENTRATION : 4 | (2) SETTING CHANGED ALL THE CONDITIONS SATISFIED |
| | (3) SETTING PARTLY CHANGED AT THE REQUEST OF USER |
| | (4) SETTING PARTLY CHANGED ACCORDING TO CIRCUMSTANCES OF USE |
| | (5) SETTING PARTLY CHANGED DUE TO LACK OF PARTS |

THIS MACHINE IS SET AT STATE I-[2], II-[1]

IN CASE OF CHANGE, PRESS C/S BUTTON, INPUT SETTING STATE IN TWO DIGIT BY TEN KEY AND MEMORIZE BY PRESSING ⇐ BUTTON

FIG.8

62

TONER CHANGE INFORMATION ( ' 89. 4. 14 )

I. CHANGE ITEM (1) TONER TYPE A
TONER
CONCENTRATION : 5
STIRRING FAN : NO SIGN
CHARGING STEP : 5

(2) TONER TYPE B
TONER
CONCENTRATION : 4
STIRRING FAN : NO SIGN
CHARGING STEP : 5

(3) TONER TYPE C
TONER
CONCENTRATION : 3
STIRRING FAN : A40
CHARGING STEP : 7

II. CHANGE STATUS (1) UNCHANGED FROM STATUS AT SHIPPING OF APPARATUS (2) SETTING CHANGED ALL THE CONDITIONS SATISFIED (3) SETTING PARTLY CHANGED AT REQUEST OF USER (4) SETTING PARTLY CHANGED ACCORDING TO CIRCUMSTANCES OF USE (5) SETTING PARTLY CHANGED DUE TO LACK OF PARTS

THIS MACHINE IS SET AT STATE I-[2], II-[1]

IN CASE OF CHANGE, PRESS C/S BUTTON, INPUT SETTING STATE IN TWO DIGIT BY TEN KEY AND MEMORIZE BY PRESSING ⇐ BUTTON

SERVICE INFORMATION

SERVICE INFORMATION IC CARD INVALID.
AFTER CONFIRMING NO CHANGE IN LATEST
INFORMATION AT SERVICE CENTER, DO
SERVICE ACCORDING TO IC CARD INFORMATION.
SERVICE INFORMATION IS DISPLAYED WHEN
PRESSING TEN KEY 0 BUTTON.

62

IMAGE FORMING DEVICE CAPABLE OF BEING MAINTAINED EASILY BY USING IC CARD

This application is a continuation of application Ser. No. 07/738,147, filed Jul. 30, 1991, now abandoned.

BACKGROUND OF THE INVENTION

1. Field of the Invention

The present invention relates generally to copying machines, and more particularly, to copying machines to which such recording media as IC cards are connectable.

2. Description of the Related Art

For maintenance of copying machines of many users, a service man takes various proper measures by referring to a management note with a setting stage, history and the like of a copying machine described therein and fills items concerning the above-described measures in the management note to prepare for the subsequent maintenance.

With respect to a copying machine of a certain user which toner is set to type A with concentration 5 at the time of shipping from a factory, for example, when the necessity arises for changing the toner concentration to 4 because all the toner supplied to the market is changed to type B, a service man changes the toner concentration of said copying machine to 4 and then fills in the management note of said copying machine that the toner type is B and the toner concentration is 4.

Also presented is a device having a memory storing the above-described setting stage, history and the like which are readable as required (Japanese Patent Laying-Open No. 62-75747).

In general, a change of a setting stage of a user's copying machine (a change of a toner concentration to meet said change of a toner type, parts replacement for improving and the like) is carried out by a service man at the time of maintenance. In other words, a setting stage of the copying machine is changed when some trouble occurs to the machine. In addition, the above-described setting change and parts change are carried out for the parts related to the above-described trouble.

Various parts of a copying machine of a certain model are improved to be supplied to the market in many cases. Therefore, it is difficult or requires great labor for even a service man to precisely understand the latest improvement level of all the parts used in all the models.

However, in order to take proper measures including a setting change to a copying machine for which the user of the machine requests a service man to be sent, it is necessary to precisely know the setting stage and the latest improvement level of the copying machine.

The setting stage of a copying machine can be seen from the description in the management note of the copying machine. However, manners describing the management note (or manners of bridging the description) differ from a service man to a service man to make understanding of the management note difficult at a rotation of the service men in charge. In addition, a used copying machine might have an imperfect management note. As described above, it is difficult or requires great labor for even a service man to know all the latest improvement levels of all the models.

The above-described copying device whose setting stage and the like can be read from a built in memory (the device disclosed in Japanese Patent Laying-Open No. 62-75747) requires complicated operations for storing data relative to a change of a setting stage in a memory and employs limited types of data which can be stored. In addition, acknowledging the latest improvement level of said copying machine of the model has the same problem as described above.

SUMMARY OF THE INVENTION

An object of the present invention is to make management of an image forming device easy.

Another object of the present invention is to take proper steps for an image forming device to meet a history of improvement of the model of the device.

A further object of the present invention is to make a setting state for a history of improvement in the model of an image forming device.

Still further object of the present invention is to effectively use recording media in an image forming device.

In order to achieve the above-described objects, the image forming device operable in response to information from a storage medium detachably provided in a main body according to one aspect of the present invention, includes a connection device connected to a storage medium storing management data indicative of the improvement history of the device, a data reading device for reading the management data from the connected storage medium, a first display device for displaying the improvement history of the device based on the read management data, an input device for inputting state data indicative of the stage in the improvement history of the device, a storing device for storing the input state data and a second display device for displaying the stage in the improvement history of the device based on the state data stored in the storage device.

With thus constituted image forming device wherein improvement history and state data of the device are displayed based on management data stored in a storage medium, management of the device can be made accurately and easily.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a diagram showing one example of a message displayed on a message display portion 62 of FIG. 1.

FIG. 8 is a diagram showing another example of a message to be displayed on the message display portion 62 of FIG. 1.

DESCRIPTION OF THE PREFERRED EMBODIMENTS

The embodiments of the present invention will be described.

In the following, "toner change information" is taken as management data and "stage" of a change item and a change status as state data.

(1) Arrangement of the Device

An arrangement of the device according to this embodiment will be described.

Figure 1:
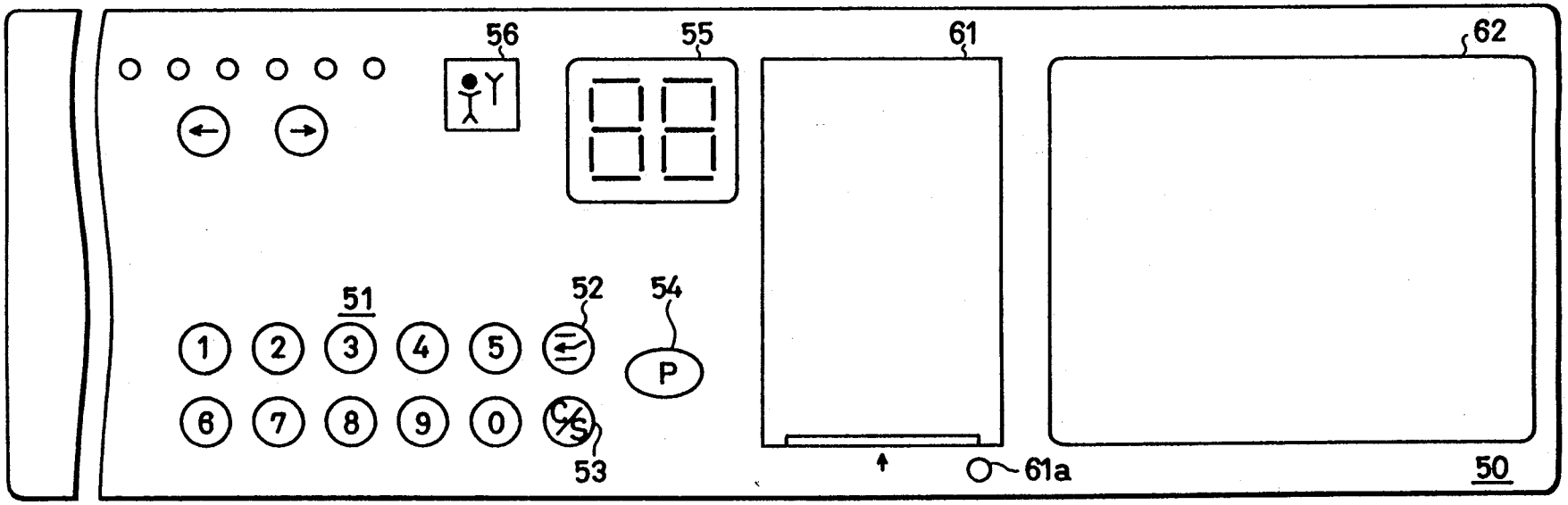
FIG. 1 is a diagram explaining an operation panel of a copying machine according to one embodiment of the present invention.
Figure 2:
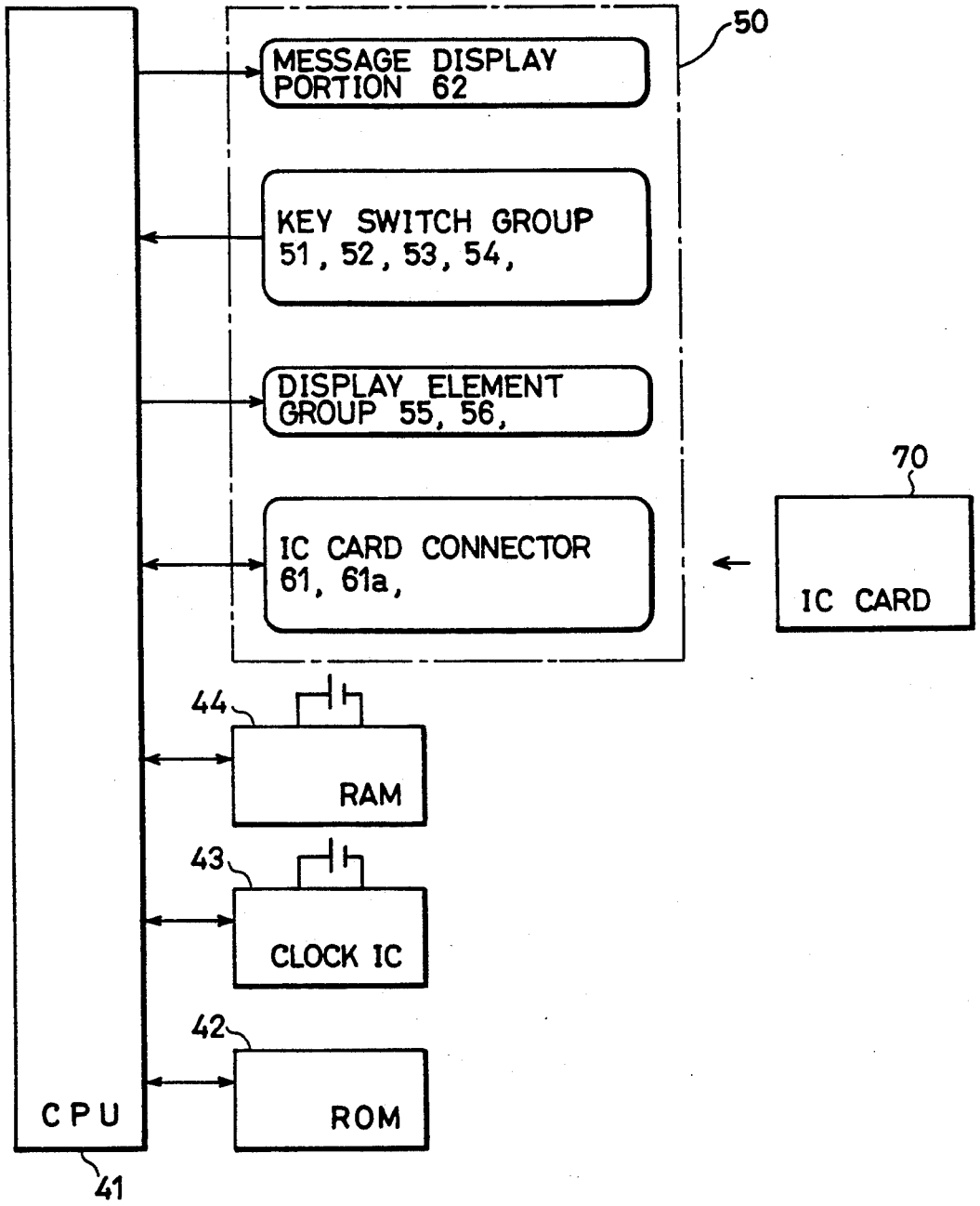
FIG. 2 is a block diagram showing an arrangement of a control circuit of the copying machine shown in FIG. 1.
Figures 9, 10:
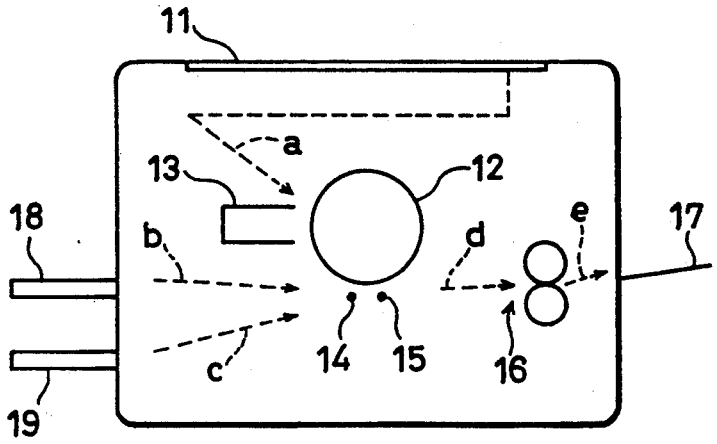
FIG. 9 is diagram showing a further example of a message to be displayed on the message display portion 62 of FIG. 1.
FIG. 10 is a schematic diagram showing an arrangement of a copying machine according to one embodiment of the present invention.
Figure 11:
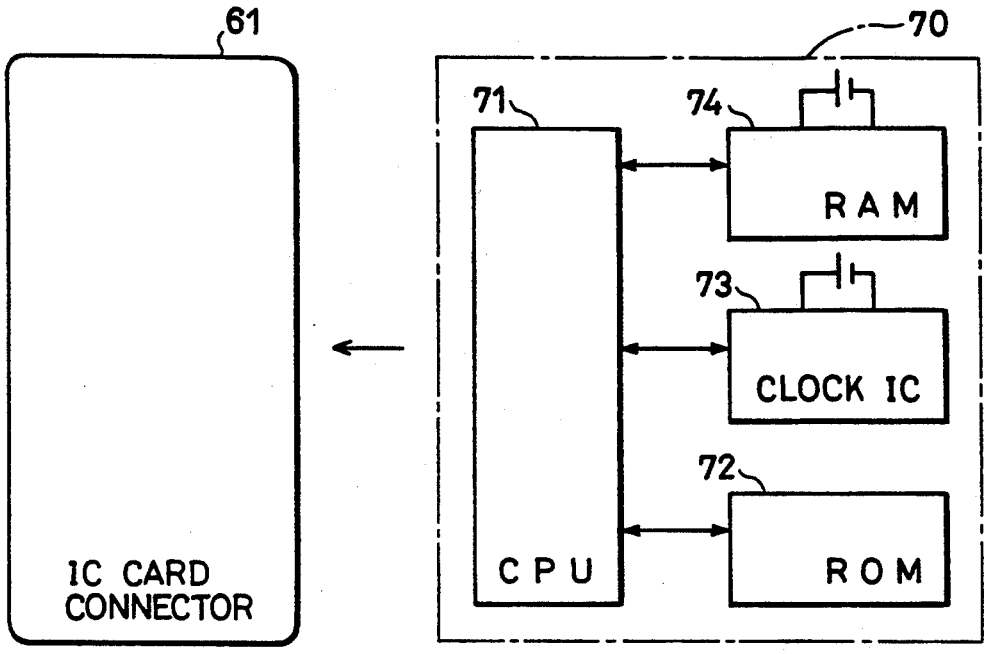
FIG. 11 is a block diagram showing an arrangement of a control circuit for use in an IC card to be connected to the copying machine of FIG. 10.

FIG. 1 is a diagram explaining an operation panel of a copying machine according to one embodiment of the present invention and FIG. 2 is a block diagram showing an arrangement of a control circuit of the copying machine. FIG. 10 is a schematic diagram showing an arrangement of the copying machine and FIG. 11 is a block diagram showing an arrangement of a control circuit for use in an IC card connected to the copying machine.

As shown in FIG. 10, in the present copying machine, image light reflected by exposure-scanning of an original on a platen glass 11 is guided taking the course indicated by broken arrow a to form an electrostatic latent image on a surface of an uniformly charged photoreceptor drum 12 rotating at a constant speed. The electrostatic latent image is developed by a developing unit 13 by using toner and visualized, which image is transferred on paper fed between the photoreceptor drum 12 and a transfer charger 14 from a paper feed cassette 18 or a paper feed cassette 19 by taking the course indicated by broken arrow b or c. Thereafter, a separating charger 15 separates the paper from the photoreceptor drum 12 and feeds the same by taking the course indicated by broken arrow d to a fixing device 16 wherein the paper is subjected to a fixing processing and then the paper is discharged onto a discharge tray 17 outside the apparatus by taking the course indicated by broken arrow e.

An operation panel 50 shown in FIG. 1 is disposed at the front side of the platen glass 11 provided on the upper surface of the copying machine. A control CPU 41 shown in FIG. 2 controls acceptance of inputs of various key switches of the operation panel 50, display control of the various display portions and data transmission/reception through an IC card connector 61.

More specifically, as shown in FIG. 1, arranged on the operation panel 50 are a message display portion 62 for displaying a message related to an IC card or a standard message (operating instructions, a remaining amount counter, instructions in case of trouble and the like), the IC card connector 61 for connecting an IC card 70 inserted from an insertion slot in the direction indicated by the arrow with the CPU 41 and a display LED element 61*a* for giving a warning by lighting when the connected IC card stores data older than the setting level of the copying machine.

Provided also on the operation panel 50 are a key switch group including a print key 54 for giving instructions for a start of a copying operation, an interruption key 52 for giving instructions for interruption, a clear/stop key 53 for giving instructions for clear of input data or stop of a copying operation and a group of ten keys 51 for inputting numerical values, and a two-digit numerical value display portion 55 and a trouble display LED element 56 for giving a warning by lighting when trouble occurs to require a service man call. The interruption key 52, the clear/stop key 53 and the numerical value display portion 55 are also used for inputting state data as will be described later (see FIG. 6).

As shown in FIG. 2, the control CPU 41 provided in the present copying machine is connected to a work RAM 44 backed up by a battery, a clock IC 43 backed up by a battery, an ROM 42 storing a control program etc. and the like.

As shown in FIG. 11, a control CPU 71 for controlling the IC card 70 is connected to a work RAM 74 backed up by a battery, a clock IC 73 backed up by a battery, an ROM 72 storing a control program etc. and the like. The clock IC 73 is used for comparison with validity data of the IC card 70 as will be described later. When the validity data of the IC card expires, the invalidity data is transmitted to the CPU 41 provided in the copying machine.

(2) Control of the Apparatus

Display control of service data (management data and state data) carried out in the present apparatus will be described with reference to the flow charts of a processing performed at the CPU 41 shown in FIGS. 3–6 and examples of display messages at the message display portion 62 shown in FIGS. 7–9.

Figure 3:
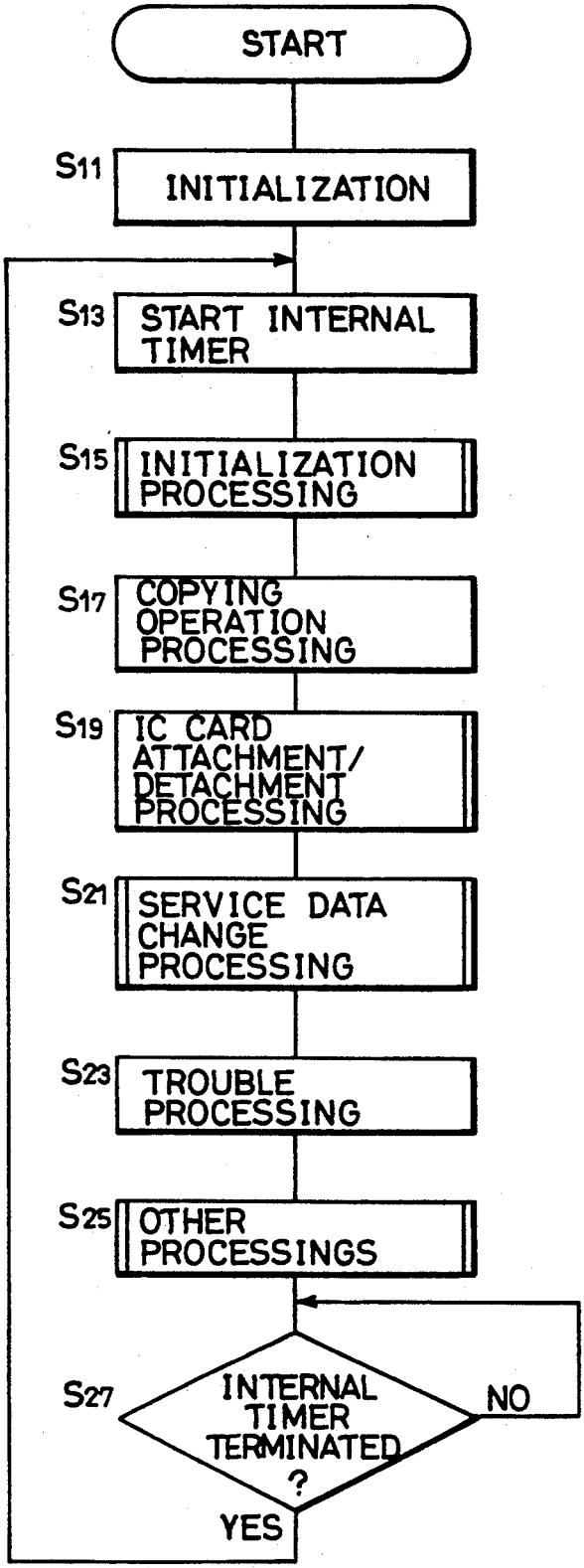
FIG. 3 is a flow chart showing a main routine of a control CPU 41 of FIG. 2.

[1] Main routine (FIG. 3)

The control CPU 41 of the copying machine starts a processing by the connection to the power supply line, for example, to execute the initialization processing first (S11). As a copying mode, a normal mode (copy magnification: equal-scale magnification, exposure amount: center, copy quantity: one, paper size: A4, for example) is set. Thereafter, the flow proceeds to the repetitional loop processing of steps S13–S27.

In other words, the internal timer for controlling a time period required for executing one routine is started (S13).

Initialization processing: S15

As will be described later, mode setting is carried out depending on the presence/absence of an IC card when the predetermined conditions of initialization are satisfied.

Copying processing: S17

Such various processings required to execute a copying operation are performed as paper feeding control, control of the photoreceptor drum 12 and the member around the same, paper transport control, fixing control and exposure scanning control.

The auto clear timer whose time up is determined by the initialization processing when the copying operation ends.

IC card attachment/detachment processing: S19

As will be described later, mode setting, display control and the like are carried out upon the attachment-/detachment of the IC card.

Service data changing processing: S21

As will be described later, a processing is carried out for registering a new setting state as state data in the RAM 44.

Trouble processing: S23

Detection of trouble such as jam causes the corresponding display element (not shown) to light up. In addition, the trouble display LED element 56 is also lighted up as necessary.

Other processings: S25

A step of collectively displaying all the processings to be executed by the CPU 41 other than those described above.

Figure 12:
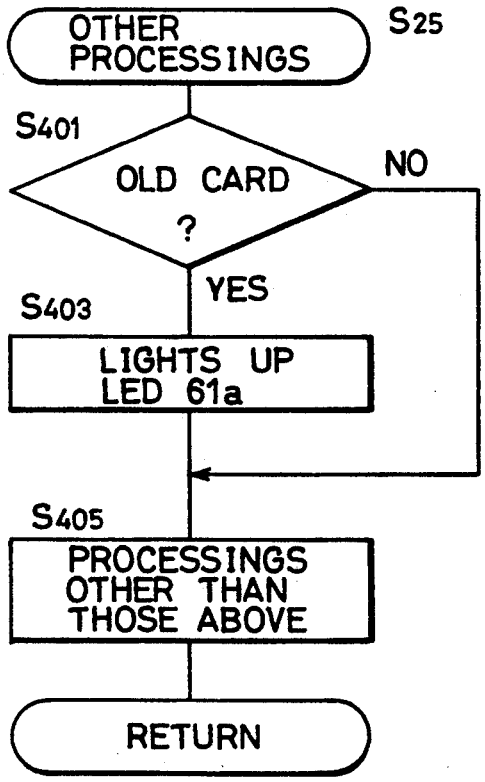
FIG. 12 is a flow chart showing the specific contents of other processing routine than that shown in FIG. 3.

During these processings, such a processing of giving warning is executed when the management data stored in the IC card is older than those of the setting stage of the copying machine (see FIG. 12).

After the above-described respective processings, wait for the end of the internal timer (YES at S27) and returns to step S13 to again executed the above-described processings repeatedly.

Figure 4:
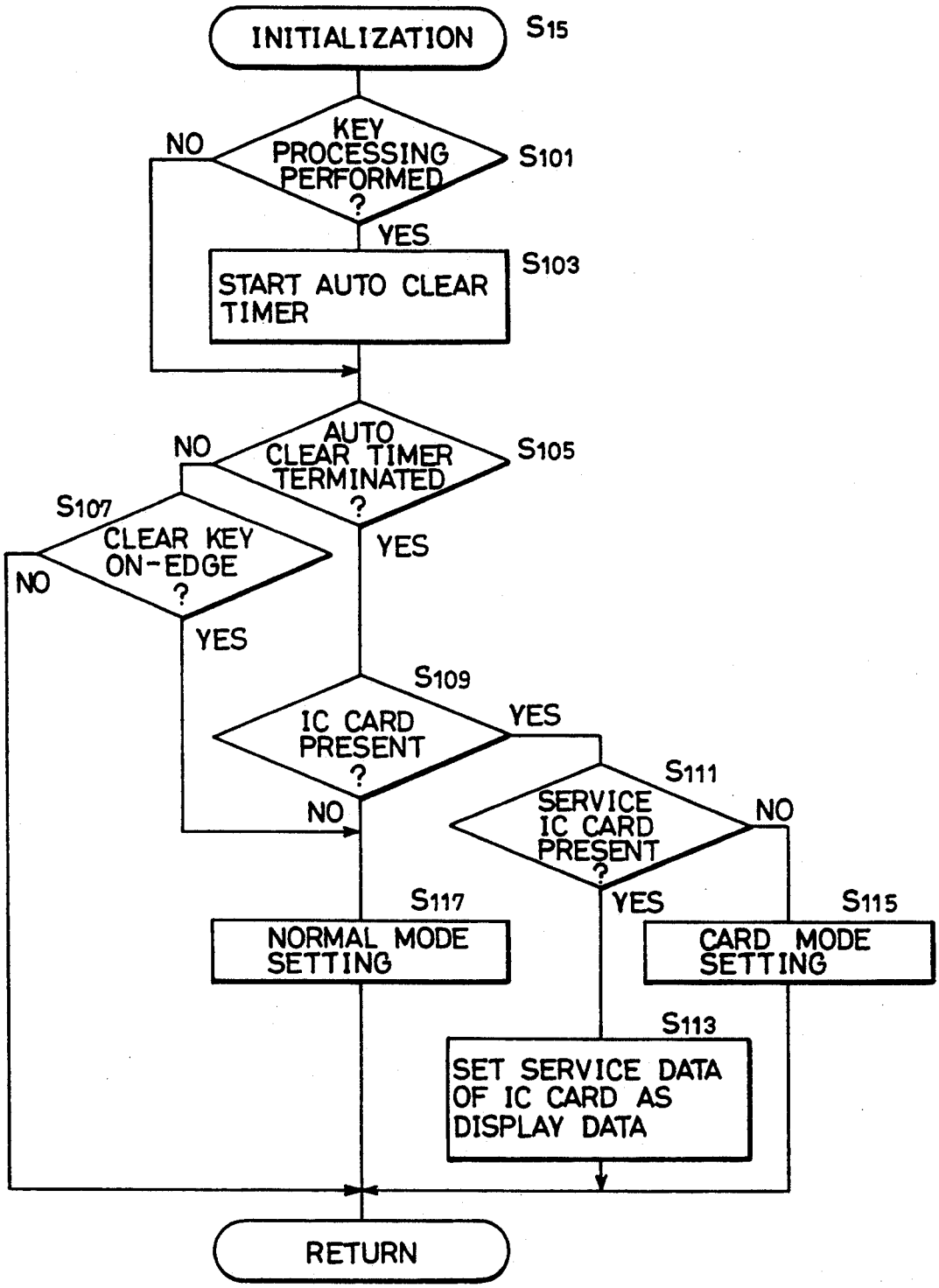
FIG. 4 is a flow chart showing the specific contents of an initialization routine shown in FIG. 3.

[2] Initialization Processing (FIG. 4).

In the present processing, initialization of the copying mode and the like are carried when predetermined initialization conditions (the end of the auto clear timer or operation of the clear/stop key 53) are satisfied.

S101–S107 are steps relative to predetermined initialization conditions.

More specifically, the auto clear timer is started (S103) by the operation of any of the key switches (YES at S101). The auto clear timer can be started also upon the end of the copying operation as described above. In addition, said predetermined initialization conditions are satisfied upon the end of the above-described auto clear timer or the operation of the clear/stop 53 (YES at S105 or YES at 107).

The above-described normal mode is set (S117) when the IC card is not connected (NO at S109) or the clear/-stop key 53 is turned on (YES at S107) at the end of the auto clear timer.

When the IC card is connected and the card is a service IC card storing management data (YES at S109 and YES at S111), the management data of the card (service data: the data shown in FIG. 7 or in FIG. 8, the details of which will be described later) is set as display data of the message display portion 62 (S113).

When an IC card is connected and the card is not a service IC card storing management data (YES at S109 and NO at S111), the copying mode registered on the card is set at the copying machine (S115). That is, the present embodiment is described on condition that the IC card connectable to the present copying machine is a service IC card or an IC card for collectively setting copying modes.

Figure 5:
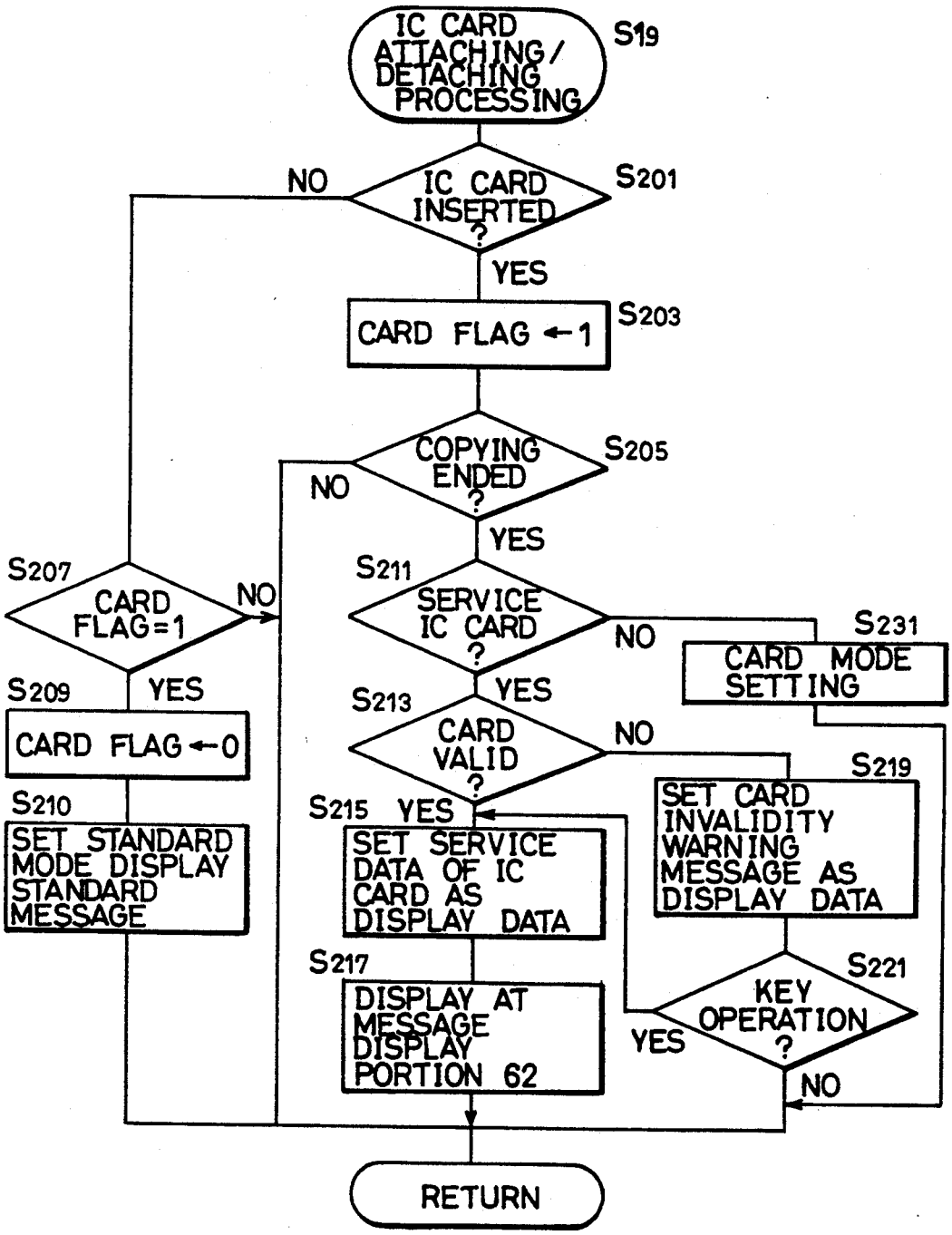
FIG. 5 is a flow chart showing the specific contents of an IC card attachment/detachment routine of FIG. 3.

[3] IC Card Attachment/Detachment Processing (FIG. 5)

In this present processing, the following processings are carried out for connecting/disconnecting the IC card.

(i) At the Time of Connection

When the IC card is connected to the IC card connector 61 (S201: YES), a card flag is set to "1" (S203). Then, determination is made as to whether copying is terminated or not (S205).

As a result, when the copying is terminated (YES at S205), determination is made as to whether or not the connected IC card is a service card storing management data (S211).

If the card is a service IC card (YES at S211) on condition that the validity data of the card does not expire (YES at S213), the management data registered on the card is set as display data (S215), which data is displayed on the message display portion 62 (S217), thereby returning the flow to the main routine. In addition, as shown in FIG. 7, the message display portion 62 also displays the state data indicative of a setting state of the copying machine at this time.

For example, in a case where the present copying machine is an apparatus shipped after Nov. 25, 1988 and not-improved copying machines of the same model have been supplied to the market before Nov. 25, 1988, when an IC card in which the improvement (change of a toner type) of Nov. 25, 1988 is introduced is connected to the copying machine, such state data indicative of a setting stage of the present copying machine as "this machine is set at a state of I-2, II-1" is displayed as well as the management data, as shown in FIG. 7. The underlines (the portion surrounded by the squares in the drawing) indicate state data which can be input by a service man as will be described later.

Thereafter, an improvement has been introduced in the model of the copying machine on Apr. 14, 1989. When an IC card corresponding to the improvement is connected to the machine, the message display portion 62 displays the management data relative to the above-described improvement together with the old management data (see FIG. 7).

At that time, the state data has not been changed by a service man and therefore, like an the above-described case, the following display is made as state data.

"This machine is set at a state of I-2, II-1".

When the service man changes the setting state of the copying machine to "toner concentration: 3, stirring fan: A40, charging step: 7" upon the user's request and then he inputs and registers the above-described change in the RAM 44 in the same manner as will be described in the following "service data changing processing (FIG. 6), the message display portion 62 makes the following display as the state data.

"*This machine is set at the state of I-3, II-2."

"Change item" and "change status" will be described.

"Change status" denotes a setting state basically set by a service man. As shown in the drawing, (1) indicates that the setting at the time of the shipment remains and (2) indicates that all the conditions of toner concentration, a stirring fan and a charging step are established to be optimum at the time of changing toner. For example, "I-2, II-2" indicates that the toner is changed for B type toner by a service man and the optimum conditions are set such as "toner concentration: 4, stirring fan: no sign, charging step:5".

"I-2, II-3" indicates that the optimum setting is partly changed by a user's request. For example, the toner concentration step is set not to "4" but to "5" to make toner concentration high as requested by a user.

II-4 indicates that a charging step (or both of a charging step and a toner concentration) is changed according to a situation of use and II-5 indicates that the stirring fan is not exchanged because of lack of parts.

As described above, "I. change item" denotes the optimum (normal) setting level for the changed toner type and "II. change status" indicates the status of the service (setting state) done by a service man.

On the other hand, when the determination is made at the above-described step S213 that the validity of the IC card expires (NO at S213), first the message display portion 62 makes the display as shown in FIG. 9 (S219) to give a warning thereof. Such warning display is switched to a display of the above-described management data and state data (S215–S217) through the manipulation of the "0" bottom of the ten key 51 (YES at S221) as shown in FIG. 9.

When the determination is made at the above-described step S211 that the connected IC card is not a service IC card but an IC card for collectively setting copying modes (NO at S211), the copying mode registered on the card is set at the copying machine and then the flow returns to the main routine (S231).

(ii) At the Time of Disconnection

When the IC card is detached from the IC card connector 61, that is, when the determination is made at step S201 that the IC card is not inserted, determination is made as to whether the card flag is set to "1" or not (S207). When the card flag is not set to "1", the flow returns to the main routine. When the card flag is set to "1", the card flag is set to "0" (S209). Then, the copying machine is set to operate in the above-described normal mode and the message display portion 62 displays the above-described standard message (operating instructions, the remaining amount counter, description of trouble and the like) (S210).

Figure 6:
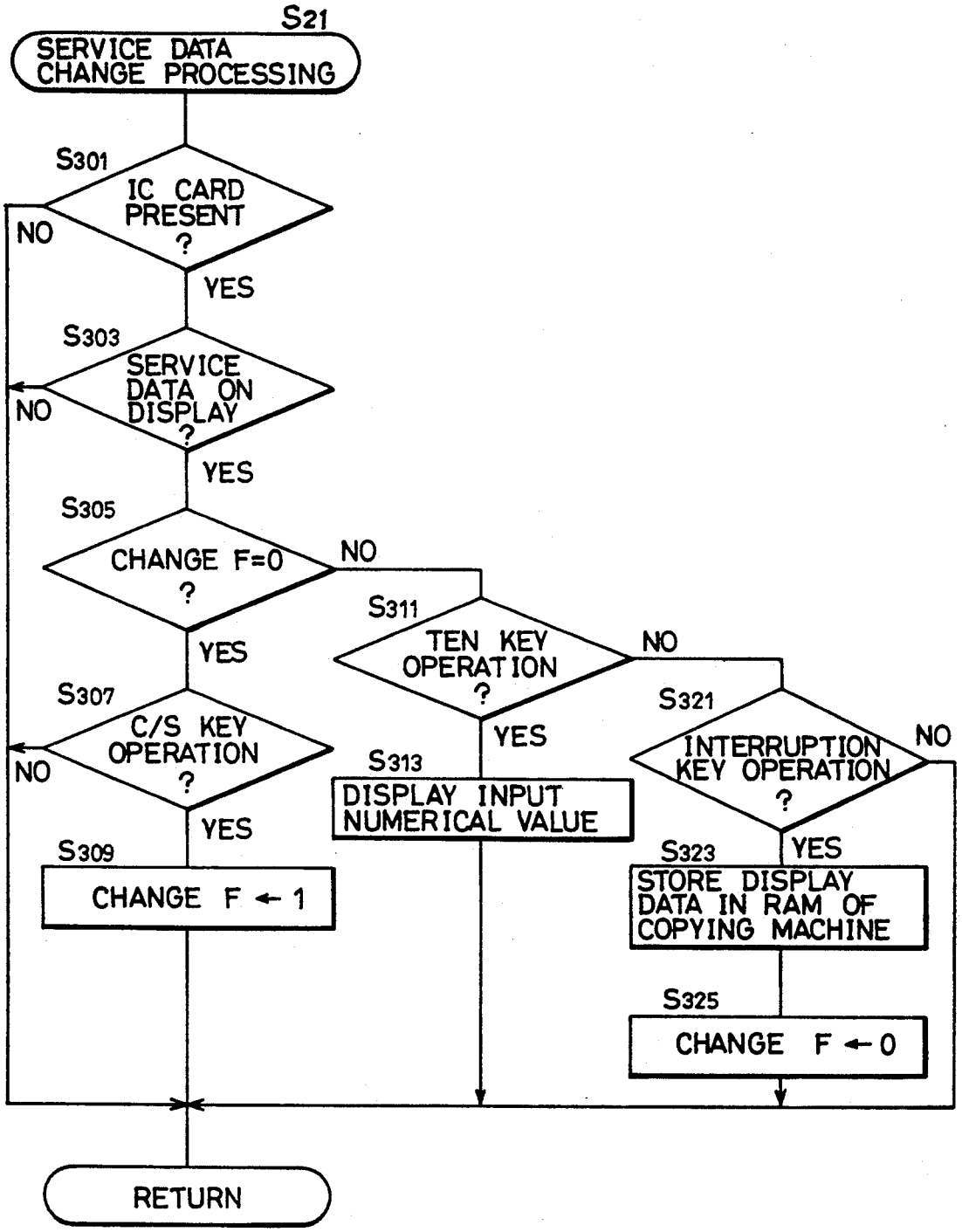
FIG. 6 is a flow chart showing the specific contents of a service data changing routine of FIG. 3.

[4] Service Data Change Processing (FIG. 6).

In this processing, control data to be registered in the RAM 44 is changed as described above.

When a service IC card is connected to the IC card connector 61 (YES at S301), the message display portion 62 displays the service data (control data and state data) (YES at S303) and the change flag is reset to "0" at the initial state (YES at S305), manipulation of the clear/stop key 53 (YES at S307) sets the change flag to "1" (S309).

Then, when the change flag is set to "1", the flow proceeds to step S311 wherein determination is made as to whether a ten key is manipulated or not. When the ten key 51 is manipulated (YES at S311), a two-digit numerical value corresponding to the manipulated ten key is displayed at the numerical value display portion 55 (S313).

Then, manipulation of the interruption key 52 (NO at S311, YES at S321) registers the two-digit numerical value data displayed at the numerical value display portion 55 as state data in the RAM 44 of the copying machine (S323). The change flag is reset to "0" (S325). The state data is changed in this way. While the above embodiment has been described by taking information on toner change as an example, the present invention is not limited to the above embodiment and is also applicable to other management data.

Although determination of the validity of the card is made by the IC card and only the determination result is transmitted to the copying machine in the present embodiment, the determination may be made by the copying apparatus with reference to the clock IC.

In addition, while the display message in case of the expiration of a card validity is prepared by the copying apparatus, the message can be prepared by the IC card to display a specific validity date and the like.

As described in the foregoing, the present invention is a copying apparatus capable of displaying management data stored in a storage medium and state data stored in the copying apparatus.

According to the present invention, all the improvements introduced in the model from the past up to the present and the present setting state of the copying machine can be easily acknowledged by connecting a storage medium whose management data is updated for every improvement introduced in the copying machine with the copying machine.

Therefore, optimum maintenance can be given to the copying machine even when a service man is replaced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus operable in response to information stored in a storage medium, comprising:
   - a main body of the image forming apparatus,
   - connection means on said main body to which said storage medium storing management data indicative of an improvement history of the apparatus may be detachably connected,
   - data reading means on the main body for reading the management data from said connected storage medium,
   - first displaying means on the main body for displaying the improvement history of the apparatus based on said read management data,
   - inputting means for inputting state data indicative of a stage in the improvement history of the device,
   - storing means for storing said input state data, and
   - second displaying means on the main body for displaying the stage in the improvement history of the apparatus based on the state data stored in said storing means.

2. The image forming apparatus according to claim 1, wherein said first displaying means and said second displaying means comprise a common display portion.

3. The image forming apparatus according to claim 1, wherein said the state data of said storing means is updated every time said storing means receives an input from said inputting means.

4. The image forming apparatus according to claim 1, further comprising:
   - determining means for determining as to whether the validity of said connected storage medium expires or not, and
   - third displaying means responsive to the determination output of said determining means for displaying the expiration of the validity of the storage medium.

5. The image forming apparatus according to claim 4, further comprising:

determining means for determining as to whether the storage medium connected to said connection means stores management data or not, and controlling means responsive to the determination output of said determining means for simultaneously activating said first displaying means and said second displaying means.

6. An image forming apparatus operable in response to information from a storage medium comprising:

a main body of the image forming apparatus, connection means on the main body to which said storage medium storing management data of the apparatus is detachably connected, data reading means on the main body for reading the management data from said connected storage medium, first displaying means on the main body for displaying a plurality of items based on said read management data, selecting means for selecting at least one of said displayed items, storing means for storing item data corresponding to said selected item, and second displaying means on the main body for displaying a predetermined item based on the item data stored in said storing means.

7. The image forming apparatus according to claim 6, further comprising:

determining means for determining as to whether validity of said connected storage medium expires or not, and third displaying means responsive to the determination output of said determining means for displaying the expiration of the validity of the storage medium.

8. The image forming apparatus according to claim 7, wherein said second displaying means and said third displaying means include a common display portion.

9. The image forming apparatus according to claim 6, further comprising:

determining means for determining as to whether the storage medium connected to said connection means stores management data, and controlling means responsive to the determination output of said determining means for simultaneously activating said first displaying means and said second displaying means.

10. The image forming apparatus according to claim 6 wherein said management data comprises service data.

11. An image forming apparatus operable in response to information from a storage medium, comprising:

a main body of the image forming apparatus, attaching means provided in the main body to which said storage medium storing management data of the apparatus is detachably attached, detecting means provided in the main body for detecting the attachment of said storage medium, permanent storing means in the main body for storing state data of the apparatus relative to said management data, and displaying means provided in the main body responsive to the detection output of said detecting means for reading said stored management data from said storage medium and state data from said storage means and for displaying the same.

12. The image forming apparatus according to claim 11, further comprising:

inputting means for inputting the state data of the apparatus, and updating means for updating the state data stored in said storing means by using the state data input in said inputting means.

13. The image forming apparatus according to claim 11, wherein said management data includes data indicative of the improvement history of the apparatus.

14. The image forming apparatus according to claim 13, wherein said state data includes data indicative of the stage in said improvement history of the apparatus.

15. The image forming apparatus according to claim 11, further comprising:

determining means for determining as to whether the attached storage medium is at a predetermined state, and controlling means responsive to the determination output of said determining means for controlling said displaying means to display a predetermined message in place of said stored management data and state data.

16. The image forming apparatus according to claim 15, wherein said predetermined state includes a state of the expiration of the validity of the storage medium and said predetermined message relates to the validity.

17. A management system of an image forming apparatus comprising:

a storage medium detachably provided at an image forming apparatus for storing management data of said image forming apparatus, detecting means provided in said image forming apparatus for detecting an attachment of said storage medium, storing means provided in said image forming apparatus for storing state data of the apparatus relative to said management data, and displaying means provided in said image forming apparatus and responsive to the detection output of said detecting means for displaying said stored management data and state data.

18. In management system according to claim 17, said image forming apparatus comprises:

inputting means for inputting state data of the apparatus, and updating means for updating the state data stored in said storing means by using the state data input by said inputting means.

19. A method of managing an image forming apparatus operable in response to information from a storage medium detachably provided at a main body, comprising the steps of:

reading management data from a storage medium detachably attached to the main body of the image forming apparatus for storing management data indicative of an improvement history of the apparatus, displaying the improvement history of the image forming apparatus based on said read management data, and storing state data indicative of a stage in the improvement history of the image forming apparatus in a permanent memory provided in the main body of the image forming apparatus.

20. The managing method according to claim 19, wherein said storing step includes a step of erasing the already stored state data and storing new state data in the memory.

21. The managing method according to claim 19, wherein state data is also displayed together with the management data including the improvement history of the device in said displaying step.

22. A method of managing an image forming apparatus, comprising the steps of:

attaching a storage medium detachably provided at the image forming apparatus for storing management data of the image forming apparatus, determining the attachment of said storage medium, reading the management data from said attached storage medium, and reading state data relative to said management data and stored in a permanent memory in said image forming apparatus, and displaying said read management data and state data.

23. The managing method according to claim 22 further comprising:

inputting new state data, and updating the state data stored in said image forming apparatus by said inputted new state data.

24. The managing method according to claim 22, wherein said determination step includes the steps of detecting the expiration of the validity of the attached storage medium and displaying the expiration of the validity detected in said detection step.

* * * * *